US008350459B2

(12) United States Patent
Qian et al.

(10) Patent No.: US 8,350,459 B2
(45) Date of Patent: Jan. 8, 2013

(54) FIELD ELECTRON EMISSION SOURCE

(75) Inventors: Li Qian, Beijing (CN); Liang Liu, Beijing (CN); Shou-Shan Fan, Beijing (CN)

(73) Assignees: Tsinghua University, Beijing (CN); Hon Hai Precision Industry Co., Ltd., New Taipei (TW)

( * ) Notice: Subject to any disclaimer, the term of this patent is extended or adjusted under 35 U.S.C. 154(b) by 337 days.

(21) Appl. No.: 12/180,210

(22) Filed: Jul. 25, 2008

(65) Prior Publication Data

US 2009/0146547 A1 Jun. 11, 2009

(30) Foreign Application Priority Data

Dec. 5, 2007 (CN) ..... 200710124827

(51) Int. Cl.

| | |
|---|---|
| ***H01J 1/46*** | (2006.01) |
| ***H01J 1/52*** | (2006.01) |
| ***H01J 17/04*** | (2006.01) |
| ***H01J 17/12*** | (2006.01) |
| ***H01J 19/38*** | (2006.01) |
| ***H01J 19/40*** | (2006.01) |
| ***H01J 21/10*** | (2006.01) |

(52) U.S. Cl. ..... 313/348; 313/309

(58) Field of Classification Search ..... 313/49, 313/422, 309, 497, 495, 496, 348, 310
See application file for complete search history.

(56) References Cited

U.S. PATENT DOCUMENTS

| | | | | |
|---|---|---|---|---|
| 5,150,019 | A * | 9/1992 | Thomas et al. | 315/350 |
| 5,541,473 | A * | 7/1996 | Duboc et al. | 313/422 |
| 5,663,608 | A * | 9/1997 | Jones et al. | 313/309 |
| 5,717,278 | A * | 2/1998 | Bartha et al. | 313/336 |
| 6,075,315 | A * | 6/2000 | Seko et al. | 313/336 |
| 2001/0005112 | A1* | 6/2001 | Saito et al. | 313/311 |
| 2001/0025962 | A1* | 10/2001 | Nakamoto | 257/137 |
| 2002/0079802 | A1* | 6/2002 | Inoue et al. | 313/309 |
| 2003/0080672 | A1* | 5/2003 | Kymissis et al. | 313/495 |
| 2005/0248256 | A1* | 11/2005 | Song et al. | 313/495 |
| 2006/0022575 | A1* | 2/2006 | Ryu et al. | 313/495 |
| 2006/0022577 | A1* | 2/2006 | Kim | 313/497 |
| 2006/0043874 | A1* | 3/2006 | Hwang | 313/495 |

(Continued)

FOREIGN PATENT DOCUMENTS

| | | |
|---|---|---|
| CN | 1405833 | 3/2003 |

(Continued)

OTHER PUBLICATIONS

Ying et al.,Flat Panel Display Technology(2006), Paragraph 6 of p. 412 and Paragraph 3 of p. 417,Posts & Telecom Press.

*Primary Examiner* — Mariceli Santiago
*Assistant Examiner* — Glenn Zimmerman
(74) *Attorney, Agent, or Firm* — Altis Law Group, Inc.

(57) ABSTRACT

A method for manufacturing a field electron emission source includes: providing an insulating substrate; patterning a cathode layer on at least one portion of the insulating substrate; forming a number of emitters on the cathode layer; coating a photoresist layer on the insulating substrate, the cathode layer and the emitters; exposing predetermined portions of the photoresist layer to radiation, wherein the exposed portions are corresponding to the emitters; forming a mesh structure on the photoresist layer; and removing the exposed portions of photoresist layer. The method can be easily performed and the achieved the field electron emission source has a high electron emission efficiency.

11 Claims, 6 Drawing Sheets

U.S. PATENT DOCUMENTS

| | | | | |
|---|---|---|---|---|
| 2007/0029919 | A1* | 2/2007 | Lee | 313/495 |
| 2007/0069631 | A1* | 3/2007 | Guo et al. | 313/497 |
| 2008/0067915 | A1* | 3/2008 | Ishida et al. | 313/495 |

FOREIGN PATENT DOCUMENTS

| | | |
|---|---|---|
| JP | 2001-035361 | 2/2001 |
| JP | J132001-167691 | 6/2001 |
| TW | 486710 | 5/2002 |
| TW | 591327 | 6/2004 |
| TW | 200605131 | 2/2006 |
| TW | 200629333 | 8/2006 |
| TW | I277120 | 3/2007 |
| TW | M309746 | 4/2007 |
| TW | 200723335 | 6/2007 |
| TW | 200739650 | 10/2007 |

* cited by examiner

FIELD ELECTRON EMISSION SOURCE

BACKGROUND

1. Field of the Invention

The present invention relates to a field electron emission source.

2. Discussion of Related Art

Field emission displays (FEDs) are relatively new, rapidly developing flat panel display technologies. FEDs are based on emission of electrons in a vacuum, and light emitted by electrons emitted from micron-sized tips in a strong electric field, accelerating, and colliding with a fluorescent material. FEDs are thin and light with high brightness. Compared to conventional technologies, e.g., cathode-ray tube (CRT) and liquid crystal display (LCD) technologies, FEDs are superior in having a wider viewing angle, lower energy consumption, a smaller size, and a higher quality display. A field electron emission source is an essential component in the FEDs.

The field electron emission source operates in a vacuum environment, where an electrical field is applied to the emitters to generate electrons. The emitters are connected to a cathode electrode. A positive gate extracts electrons from the emitters through a vacuum gap. In order for emission to occur, a strong electric field is required. A high field emission efficiency can be achieved by sharpening the emitters to a high aspect ratio and by lowering a distance between the emitters and the gate.

The widest known field emission electron source is the Spindt-type field emitter, which uses a conical or pyramid micro-tip closer to the gate as emitter. However, a current leakage is possible between the emitter and the gate, which prevents a wide application thereof. Recently, various nano-structures, such as nanotubes and nano-wire, have been successfully synthesized. They have a high aspect ratio. However, the field emission electron source having nano-structures has low stability. Further, because distances between adjacent nano-structures is small, a strong shielding effect is produced, lowering the field emission efficiency.

What is needed, therefore, is a field electron emission source with high field electron emission efficiency, high stability, and low current leakage, and a method for manufacturing the field electron emission source.

BRIEF DESCRIPTION OF THE DRAWINGS

Many aspects of the present field electron emission source and the present method for manufacturing the same can be better understood with reference to the following drawings. The components in the drawings are not necessarily to scale, the emphasis instead being placed upon clearly illustrating the present field electron emission source and the present method.

DETAILED DESCRIPTION OF PREFERRED EMBODIMENTS

Referring to FIGS. 1-6, a method for manufacturing a field electron emission source includes the steps of:

(a) providing an insulating substrate, depositing a cathode layer on the selective portion of the substrate;

(b) patterning a number of emitters on the cathode layer;

(c) coating a photoresist layer on the substrate, the cathode layer and the emitters;

(d) exposing portions of the photoresist layer to radiation, the portions thereof corresponding to the emitters;

(e) forming a mesh structure on the photoresist layer; and (f) removing the exposed portions of photoresist layer, thereby achieving a spacer spaced from the emitters.

Figure 1:
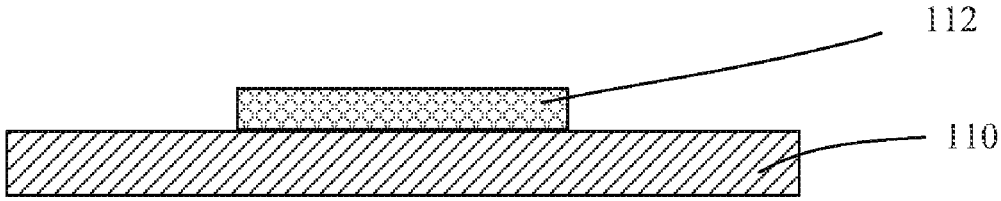
FIGS. 1-6 are highly schematic representations of steps in a method for manufacturing a field electron emission source, according to one embodiment.

In step (a), as shown in FIG. 1, an insulating substrate 110 is provided. The insulating substrate 110 can be made of any insulating suitable material, e.g., glass, plastic, and silicon with an insulating layer formed thereon. The insulating substrate 110 can also be a substrate covered with an insulating layer. In the embodiment, the insulating substrate 110 is a silicon wafer covered with a silicon dioxide layer. The cathode layer 112 is made of one or more conductive metals, for example, gold, silver, copper, chromium, molybdenum, alloys thereof, or heavily doped silicon. In the embodiment, a pattern of cathode layer 112 is formed on the insulating substrate 110 by the steps of: depositing a silicon layer on the insulating substrate 110; heavily doping the silicon layer; and etching the heavily doped silicon in predetermined positions to form the cathode layer 112.

Figure 2:
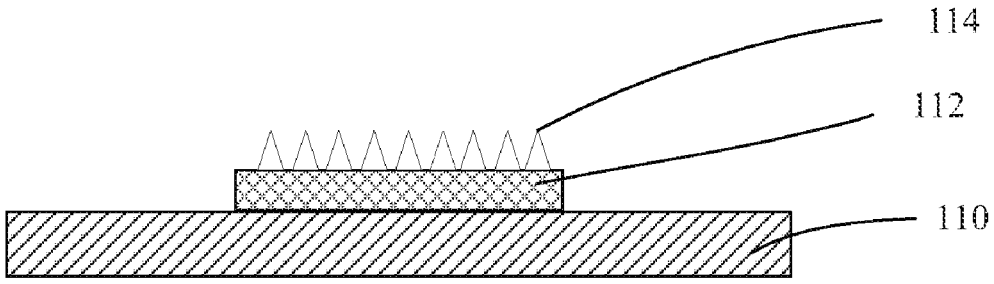

In step (b), as shown in FIG. 2, the emitters 114 are made of any suitable low-work-function material. In the embodiment, the emitters 114 are made of silicon and formed by a conventional micro-processing technology. Another low-work-function material, for example, metal carbide, can also be deposited on the emitters 114 to facilitate electron emission.

Figure 3:
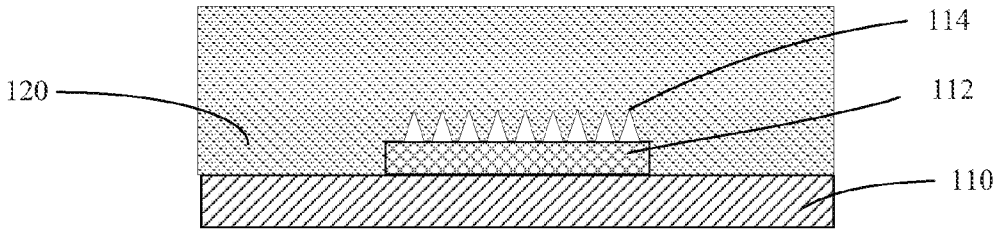

In step (c), as shown in FIG. 3, the photoresist layer 120 is formed. The photoresist layer 120 has a thickness of about 50-1000 microns and can be made of any suitable insulating material, for example, poly-methylmethacrylate (PMMA). Any thick-film process can be used to form the photoresist layer 120.

Figure 4:
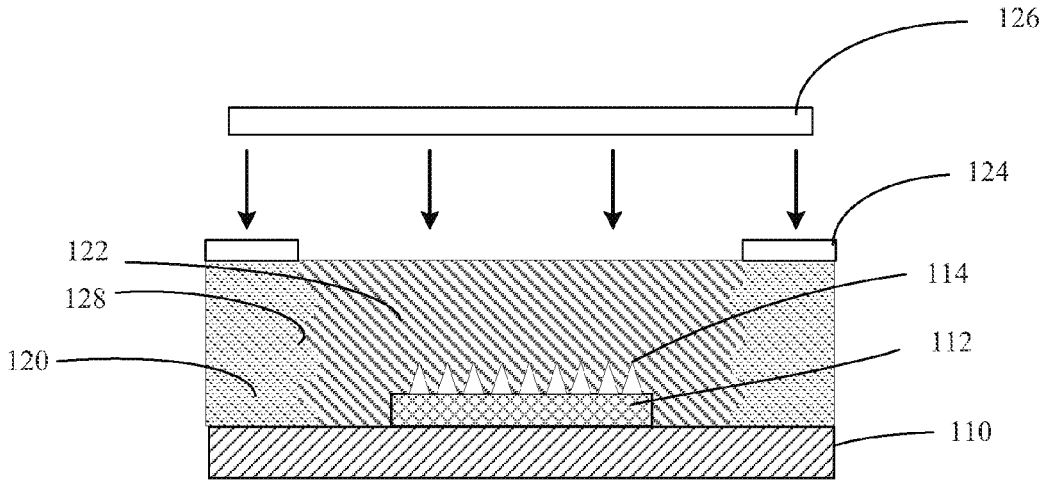

In step (d), as shown in FIG. 4, a mask 124 is used to permit exposure of only selected portions 122 of the photoresist layer 120 to a radiation source 126. The photoresist layer 120 is exposed to radiation, such as high energy X-rays (synchrotron radiation). Therefore, the exposed portions of the photoresist layer 120 are chemically modified by exposure to radiation of a selected wavelength. In operation, the high energy X-rays penetrate the photoresist layer 120 through a selected portion 122, and then arrive at and are reflected by the insulating substrate 110 and the emitters 114. The reflected X-rays also irradiate the inner sidewall 128 of the photoresist layer 120, and a number of exposed portions are also formed thereon. This process is a deep-etch lithography process.

Figure 5:
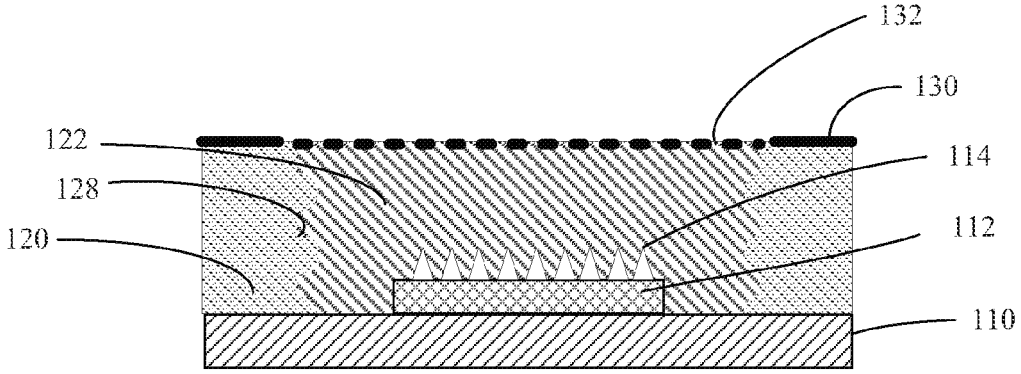

In step (e), as shown in FIG. 5, the mesh structure 130 is formed by the steps of: depositing a metal layer on a surface of the photoresist layer 120 opposite to and corresponding to the positions of the emitters 114; etching the metal layer in selected portions to define a number of through holes by a conventional photolithography method. In addition, the mesh structure 130 can be a metal gridding or a carbon nanotube film, and be directly arranged on the photoresist layer 120. A number of through holes 132 are defined in the mesh structure 130.

Figure 6:
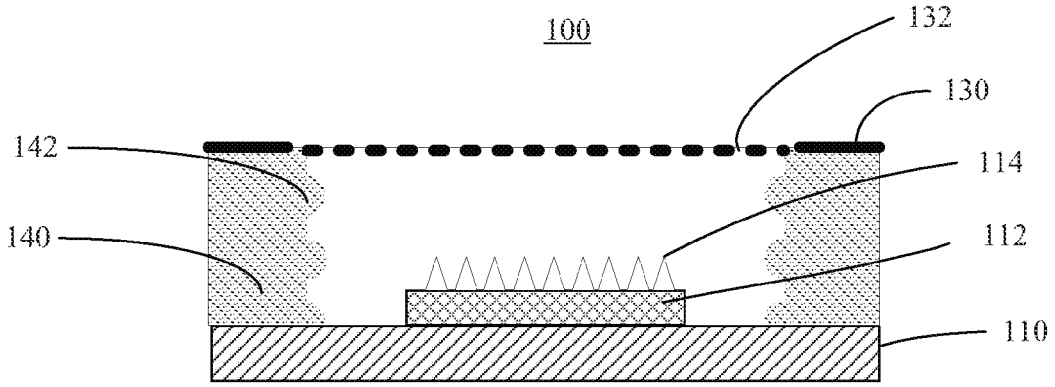

In step (f), as shown in FIG. 6, the exposed portions of photoresist layer 120 are removed by a developer. That is, the non-exposed portions of photoresist layer 120 remain insoluble, while the exposed portions thereof become soluble in the developer. After removing of the selected portion 122, the remaining portions of the photoresist layer 120 form spacers 140 on the insulating substrate 110. The spacers 140 are configured to support the mesh structure 130 and to separate the mesh structure 130 from the emitter 114. Further, the exposed portion on the inner sidewall of the photoresist layer 120 is removed, and a number of protrusions 142 are formed on the inner sidewalls of the spacers 140.

The field electron emission source 100 manufactured by the above method includes an insulating substrate 110, a cathode layer 112, emitters 114, spacers 140 and a grid 130. The cathode layer 112 is deposited on the insulating substrate 110. The emitters 114 are deposited on the cathode layer 112. The spacers 140 are formed on the insulating substrate 110 and distanced from the cathode layer 112. The grid 130 is spaced from the insulating substrate 110 by spacers 140. Two opposite edges of each spacer 120 are respectively in contact with the insulating substrate 110 and the grid 130. The grid 130 is also spaced from the emitters 114. A number of holes 132 are defined in the grid 130. In operation, electrons are emitted from the emitters 114, run toward the grid 130, and then through the holes 132.

The insulating substrate 110 is made of any suitable insulating material, such as glass and silicon dioxide. A thickness of the insulating substrate 110 is about 10-5000 microns.

The cathode layer 112 and the grid 130 can be made of any conductive material, exemplarily, metal and heavily doped silicon. The cathode layer 112 covers a portion of the insulating substrate 110, and a thickness of the cathode layer 112 is in an approximate range of 10-100 microns.

The emitters 114 form a micro-tip array. In the micro-tip array, the emitters 112 are uniformly arranged therein. A height of emitters 114 is about 1-20 microns and a separation between adjacent tips of the emitters 114 is about the same to the height of the emitters 114 to reduce shielding effect. The emitters can be made of a low-work-function material. Moreover, a low-work-function layer can be deposited on the tips of the emitters 112 to improve field emission efficiency thereof. The low-work-function material is selected from a group consisting Lanthanum Hexaboride ($LaB_6$), Yttrium Oxide ($Y_2O_3$), Barium Oxide (BaO), Hafnium Carbide (HfC), Zirconium carbide (ZrC), Tungsten-Barium (W—Ba), W—La, and Sodium-Thorium (Na—Th). The emitters 112 can have any suitable shapes, such as conical and pyramid.

The grid 130 is made of a metal material, a metal gridding or a carbon nanotube film.

The spacers 140 are configured for supporting and insulating the grid 130 from the emitters 114. A height of a spacer 140 is about 50-1000 microns, a distance between the edges of cathode layer 112 and a spacer 140 is substantially more than 20 microns, and thus a higher voltage can be applied between the grid 130 and the cathode layer 112. The protrusions 142 are formed on the inner sidewall of the spacer 140, which increase the surface distance from the grid 130 to the cathode layer 112. A current leakage can flows along a surface of the spacer 140. Due to the protrusions, a risk for the current leakage from the grid 130 to the cathode layer 112 is reduced. Therefore, the voltage applied between the grid 130 and the cathode layer 112 can be further improved.

Finally, it is to be understood that the embodiments mentioned above are intended to illustrate rather than limit the invention. Variations may be made to the embodiments without departing from the spirit of the invention as claimed. The above-described embodiments illustrate the scope of the invention but do not restrict the scope of the invention.

What is claimed is:

1. A field electron emission source comprising:

an insulating substrate;

a cathode layer deposited on the insulating substrate;

a plurality of emitters formed on the cathode layer;

at least one spacer arranged on the insulating substrate, and a distance between the cathode layer and the at least one spacer is more than 20 microns;

a plurality of protrusions formed on inner sidewalls of the at least one spacer; and a grid spaced apart from the insulating substrate by the at least one spacer, a plurality of through holes defined in the grid corresponding to positions of the emitters, wherein opposite edges of the at least one spacer respectively contact the insulating substrate and the grid.

2. The field electron emission source as claimed in claim 1, wherein the substrate is made of a material selected from the group consisting of glass, plastic material, and silicon with an insulating layer formed thereon.

3. The field electron emission source as claimed in claim 1, wherein the cathode layer is made of a material selected from the group consisting of gold, silver, copper, chromium, molybdenum, alloys thereof, and heavily doped silicon.

4. The field electron emission source as claimed in claim 1, wherein the emitters are made of a low-work-function material, or a conductor with a low-work function layer deposited thereon.

5. The field electron emission source as claimed in claim 4, wherein the low-work-function material is selected from the group consisting of $LaB_6$, $Y_2O_3$, BaO, HfC, ZrC, W—Ba, W—La, and Na—Th.

6. The field electron emission source as claimed in claim 1, wherein the emitters form a micro-tip array.

7. The field electron emission source as claimed in claim 1, wherein a height of the emitters is about 1 micron to 20 microns, and a separation between adjacent tips of the emitters is about the same to the height of the emitters.

8. The field electron emission source as claimed in claim 1, wherein the at least one spacer has a height of about 50 microns to about 1000 microns.

9. The field electron emission source as claimed in claim 1, wherein the at least one spacer is made of an insulating material.

10. The field electron emission source as claimed in claim 9, wherein the at least one spacer is made of poly-methylmethacrylate.

11. The field electron emission source as claimed in claim 1, wherein the grid is a metal gridding or a carbon nanotube film.

* * * * *